US008746130B2

(12) United States Patent
Wackerle et al.

(10) Patent No.: US 8,746,130 B2
(45) Date of Patent: Jun. 10, 2014

(54) DIAPHRAGM PUMP

(75) Inventors: Martin Wackerle, München (DE); Martin Richter, Munich (DE)

(73) Assignee: Fraunhofer-Gesellschaft zur Foerderung der Angewandten Forschung E.V., Munich (DE)

( * ) Notice: Subject to any disclaimer, the term of this patent is extended or adjusted under 35 U.S.C. 154(b) by 1084 days.

(21) Appl. No.: 12/739,366

(22) PCT Filed: Oct. 22, 2007

(86) PCT No.: PCT/EP2007/009144
§ 371 (c)(1), (2), (4) Date: Nov. 19, 2010

(87) PCT Pub. No.: WO2009/052842
PCT Pub. Date: Apr. 30, 2009

(65) Prior Publication Data
US 2011/0061526 A1 Mar. 17, 2011

(51) Int. Cl.
*F16J 3/02* (2006.01)
*F04B 17/03* (2006.01)

(52) U.S. Cl.
USPC ..... 92/103 M; 92/98 R; 417/413.2

(58) Field of Classification Search
USPC ..... 92/96, 98 R, 101, 103 R, 103 M; 417/322, 413.2
See application file for complete search history.

(56) References Cited

U.S. PATENT DOCUMENTS

| | | | |
|---|---|---|---|
| 5,529,465 | A | 6/1996 | Zengerle |
| 5,759,014 | A | 6/1998 | Van Lintel |
| 6,109,889 | A | 8/2000 | Zengerle |
| 6,164,933 | A | 12/2000 | Tani |
| 6,261,066 | B1 | 7/2001 | Linnemann |
| 2005/0123420 | A1 | 6/2005 | Richter |
| 2006/0140782 | A1 | 6/2006 | Weber |

FOREIGN PATENT DOCUMENTS

| | | | |
|---|---|---|---|
| DE | 41 43 343 | A1 | 3/1993 |
| DE | 195 46 570 | C1 | 3/1997 |
| DE | 197 19 862 | A1 | 11/1998 |
| DE | 199 18 694 | | 11/1999 |
| DE | 102 38 600 | A1 | 3/2004 |
| DE | 102 42 110 | A1 | 3/2004 |
| EP | 0424087 | | 4/1991 |
| EP | 1 548 284 | A2 | 6/2005 |
| JP | 05-001669 | | 1/1993 |

OTHER PUBLICATIONS

Int'l Search Report mailed Jul. 30, 2008 for parallel PCT application No. PCT/EP2007/009144, 14 pages.
Int'l Preliminary Report on Patentability and CH II demand mailed Dec. 17, 2009 for parallel PCT application No. PCT/EP2007/009144, 13 pages.

*Primary Examiner* — Michael Leslie
(74) *Attorney, Agent, or Firm* — Michael A. Glenn; Perkins Coie LLP

(57) ABSTRACT

A diaphragm pump includes a pump chamber having an inlet opening and an outlet opening. A passive silicon check valve is provided at the inlet opening, and a passive silicon check valve is provided at the outlet opening. The diaphragm pump further includes a metallic pump diaphragm that adjoins the pump chamber.

13 Claims, 5 Drawing Sheets

DIAPHRAGM PUMP

CROSS-REFERENCE TO RELATED APPLICATION

This application is a U.S. National Phase entry of PCT/EP2007/009144 filed Oct. 22, 2007 which is incorporated herein by references hereto.

BACKGROUND OF THE INVENTION

The present invention relates to diaphragm pumps.

Micro pumps taking up little installation space have been known from conventional technology. For example, from DE 197 19 862 A1, a micro diaphragm pump comprising passive check valves has been known which comprises a pump diaphragm that is movable into first and second positions by means of driving means. A pump body is connected to the pump diaphragm to define a pump chamber between them. An inlet opening and an outlet opening are each provided with passive check valves. In addition to a piezoelectric drive for the pump diaphragm, an electrostatic drive has also been described. The pump diaphragm and check valves are structured in respective silicon substrates. In addition, starting materials mentioned for the pump diaphragm are, in addition to silicon, glass or plastic.

Typical dimensions of known micro diaphragm pumps in the form of silicon pumps with piezo drive are $7\times7\times1$ mm$^3$. In addition, plastic pumps with piezo drive have been known.

A micro peristaltic pump consisting of a base element and a diaphragm element is described in DE 102 38 600 A1. The base element has three fluidically interconnected chambers formed therein whose volumes are independently variable by the diaphragm element by means of actuating means. Two chambers represent valve chambers, whereas one chamber represents a pump chamber. The base element may be injection-molded from plastic or be machined, by means of precision engineering, from a suitable material, for example metal. The diaphragm element may be formed from silicon, a metal foil or an elastomer diaphragm. In addition to piezo actuators, electrostatic actuators or pneumatic drives for the diaphragm areas have been mentioned.

Micro pumps that have been described in conventional technology and offered on the market have a maximum delivery rate of 10 to 20 ml/min for water, and a maximum of 100 ml/min for air.

For micro peristaltic pumps, the fluid to be pumped, i.e. the liquid or gas, may be moved through a long and narrow channel during each pump cycle, the corresponding forward resistances being high. Therefore, micro peristaltic pumps deliver smaller volumes, while taking up the same amount of installation space, than micro diaphragm pumps having passive check valves.

SUMMARY

According to an embodiment, a diaphragm pump may have: a pump chamber including an inlet opening and an outlet opening; a passive silicon check valve at the inlet opening; a passive silicon check valve at the outlet opening; a metallic pump diaphragm that adjoins the pump chamber; and an actuator for moving the pump diaphragm from a first end position, which defines a first pump chamber volume, to a second end position, which defines a second pump chamber volume, a difference between the first pump chamber volume and the second pump chamber volume defining a stroke volume, the pump chamber including a pump chamber floor, which is opposite the metallic pump diaphragm, said pump chamber floor being adapted to the maximum deflection of the pump diaphragm, a gap remaining between the pump chamber floor and the pump diaphragm when the pump diaphragm is in the end position, which defines a smaller pump chamber volume than the other end position, which gap offers, for a flow through same, a flow resistance no larger than a flow resistance of the passive check valve at the outlet opening or than a flow resistance of the passive check vale at the inlet opening, wherein the check valves include a valve flap and a support ridge on which the valve flap rests when the check valve is closed, said support ridge including a width of ≤50 μm, ≤50 μm, ≤10 μm, or ≤5 μm, and wherein the gap that remains between the pump chamber floor and the pump diaphragm when the pump diaphragm is in the end position that defines a smaller pump chamber volume than the other end position is larger in the central area of the pump chamber than in an edge area of same. According to another embodiment, a diaphragm pump may have: a pump chamber including an inlet opening and an outlet opening that are provided with passive check valves; a pump diaphragm that adjoins the pump chamber; and an actuator for actuating the pump diaphragm at an operating frequency that is smaller than a self-resonant frequency of valve flaps of the passive check valves, a largest extension of the pump diaphragm in one direction being ≤50 mm; and the extension and a thickness of the pump diaphragm, a flow resistance of the passive check valves, and a shape of the pump chamber with regard to a dead volume and a flow resistance being configured such that a delivery rate of the diaphragm pump, when the pump diaphragm is actuated at the operating frequency, being ≥40 ml/min for a liquid to be delivered, or ≥250 ml/min for a gas to be delivered, wherein the pump chamber includes a pump chamber floor, which is opposite the pump diaphragm, said pump chamber floor being adapted to the maximum deflection of the pump diaphragm, and a gap remaining between the pump chamber floor and the pump diaphragm when the pump diaphragm is in the end position, which defines a smaller pump chamber volume than the other end position, which gap offers, for a flow through same, a flow resistance no larger than a flow resistance of the passive check valve at the outlet opening or than a flow resistance of the passive check vale at the inlet opening, wherein the check valves include a valve flap and a support ridge on which the valve flap rests when the check valve is closed, said support ridge including a width of ≤50 μm, ≤50 μm, ≤10 μm, or ≤5 μm, and wherein the gap that remains between the pump chamber floor and the pump diaphragm when the pump diaphragm is in the end position that defines a smaller pump chamber volume than the other end position is larger in the central area of the pump chamber than in an edge area of same.

Embodiments of the present invention are based on the inventors' finding that a micro diaphragm pump having a high delivery rate and a small design size may be implemented at low expenditure when passive check valves made of silicon are used that can be implemented with a high natural frequency, whereas the pump diaphragm is implemented from metal, which, given the size that may be used, is possible with clearly reduced expenditure as compared to silicon diaphragms.

Embodiments are based on the finding that with a largest extension of the pump diaphragm in one direction (which for a round pump diaphragm is the diameter) of 50 mm or below this, diaphragm pumps may achieve a delivery rate of ≥40 ml/min for a liquid, or ≥250 ml/min for a gas to be delivered. To be able to achieve this, it is advantageous to implement the valve flaps to have a high self-resonant frequency, since the operating frequency at which the pump diaphragm is operated is advantageously smaller than the self-resonant frequency of the valve flaps of the passive check valves. In addition, in embodiments of the present invention, the pump diaphragm is designed, with regard to the radius and the thickness, to obtain a stroke volume and counterpressure that may be used.

Embodiments of the present invention are directed to micro diaphragm pumps, which term in this context is to be understood to mean diaphragm pumps whose stroke volumes are within the microliter range and below. Embodiments of the invention may comprise a stroke volume of between 50 nl and 50 μl. Embodiments of the present invention may further comprise dimensions determining their functions, such as valve thickness, diaphragm thickness, width of the support ridge, or height of the pump chamber, which are within the micrometer range, e.g. between 4 μm and 200 μm.

That operating frequency of a diaphragm pump or micro diaphragm pump having passive check valves at which the delivery characteristic leaves the linear range may be considered as a cutoff frequency $f_g$. Said cutoff frequency depends on the flow resistance of the passive check valves and on the fluidic capacitances of the diaphragm pump. To increase the cutoff frequency, which enables increased delivery, it is advantageous, in embodiments of the present invention, to reduce the flow resistance of the valves, and to reduce the fluidic capacitances of the pump diaphragm, of the passive check valves and of gas bubbles within the pump.

In embodiments of inventive diaphragm pumps, silicon micromechanics is employed only where it is advantageous, namely for the passive check valves; in some embodiments, the passive silicon valves are implemented to be as small as possible, so that they remain inexpensive.

In embodiments of the invention, a pump chamber body is provided which has the pump chamber formed therein. This pump chamber body may be made of plastic, for example by means of injection molding; however, machining, or utilization of other materials such as silicon, metal and the like for the pump chamber body is also possible.

In embodiments of the invention, the pump chamber is shaped such that the dead volume is reduced to a large extent, while the flow resistance is minimized at the same time. In embodiments, the dead volume may be shaped such that the residual chamber gap is larger, in an area located opposite the outlet and/or inlet opening(s), than in an area spaced apart from same. In the case of a round pump diaphragm, wherein the inlet opening and the outlet opening are arranged within a central area opposite the pump diaphragm, the residual chamber gap may be larger in the center of the pump diaphragm than at the edge of the pump diaphragm, for example.

In embodiments of the invention, the pump diaphragm is formed of metal, for example stainless steel. This enables implementing pump diaphragms having a sufficient size and a sufficiently large stroke volume for the existing pressure requirements so as to enable the desired delivery rates. In this case, metal diaphragms are advantageous as compared to silicon diaphragms, since the cost of silicon diaphragms scales with the surface area, so that diaphragms having a size that may be useful for the desired delivery rates would be clearly more expensive. In addition, metal diaphragms, for example stainless-steel foils, may comprise a similar modulus of elasticity as silicon, and may also have good mechanical properties. Alternatively, in addition to stainless steel, other metals may be used for the diaphragm, for example titanium, brass, aluminum, or copper.

In embodiments of the invention, a piezo ceramic is used as a drive for the pump diaphragm. In embodiments, the piezo ceramic forms, along with the pump diaphragm, a piezo bending converter that may be operated by having an alternating voltage applied to it so as to provide a deflection of the pump diaphragm from a first end position to a second end position which has an operating frequency and a stroke volume that may be useful for the desired delivery rate. Alternatively, other drives, for example electrostatic, magnetic, pneumatic or hydraulic drives, may be used for the pump diaphragm.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
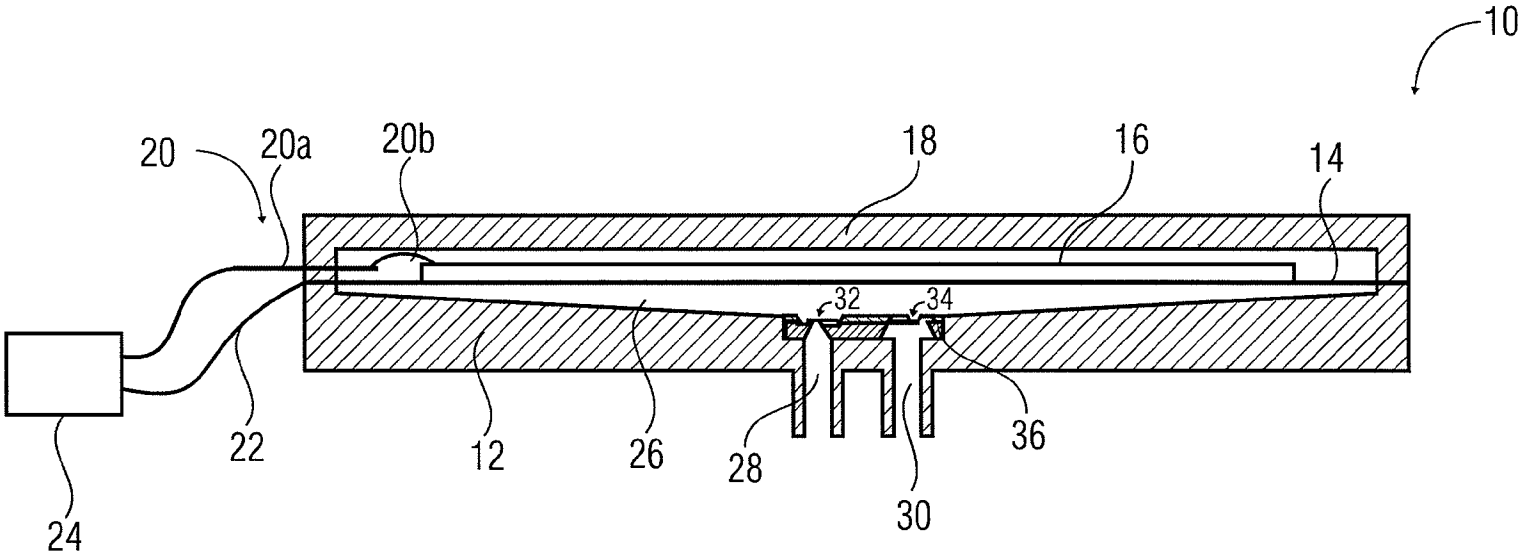
FIG. 1 shows a schematic cross sectional view of an embodiment of an inventive diaphragm pump.

A schematic cross sectional view of an embodiment of an inventive diaphragm pump 10 is shown in FIG. 1. The diaphragm pump 10 comprises a pump body 12, a pump diaphragm 14, a piezo actuator 16 arranged on the pump diaphragm 14, and a cover 18. In embodiments, the piezo actuator 16 and the pump diaphragm 14 form a piezo bending converter. A driver means 24 is provided for applying, via electric connections 20 and 22, the voltages that may be useful for actuating the piezo actuator. In embodiments of the invention, the pump diaphragm 14 is a metallic pump diaphragm, so that the electric connection 22 may apply a first potential to the piezo actuator 16 via the pump diaphragm 14. In embodiments, the second potential is applied to the opposite side of the piezo actuator via the electric connection 20 which may comprise, for example, a metal platelet 20*a* and a bonding wire 20*b*.

The pump body 12 comprises a recess which together with the pump diaphragm 14 defines a pump chamber 26. In the embodiment shown, the pump diaphragm 14 is arranged between the pump body and the cover 18. The pump body 12 and the cover 18 may consist of plastic and be produced by means of injection molding, for example. The pump body 12 has an inlet opening 28 and an outlet opening 30 formed therein. The inlet opening 28 and the outlet opening 30 may comprise suitable structures for allowing hoses or the like to be connected. In embodiments, the inlet opening 28 and the outlet opening 30 may be provided with respective Luer connectors.

In addition, the inlet opening 28 and the outlet opening 30 are provided with passive check valves 32 and 34, respectively. In the example shown, the passive check valves 32, 34 are formed within a check valve module 36 inserted into a suitable recess within the pump body 12.

Figure 2:
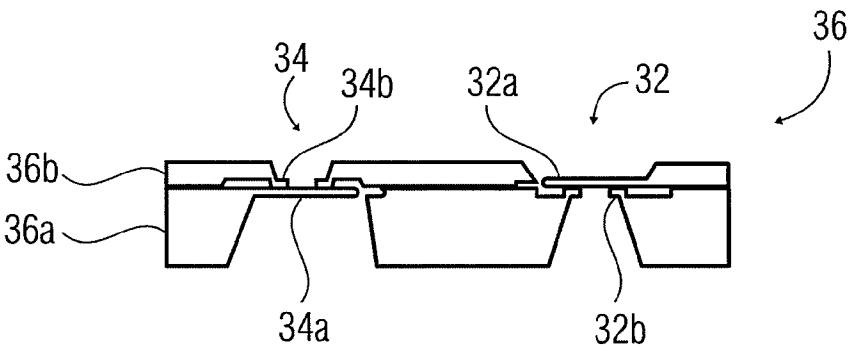
FIG. 2 shows a schematic cross sectional view of a check valve module used in an embodiment.

A magnified representation of the check valve module 36, however reversed, is shown in FIG. 2. In embodiments of the invention, the check valve module 36 has a shape as is described in DE 197 19 862 A1. However, it is evident that the inlet opening 28 and the outlet opening 30 may be provided with any check valves that provide the corresponding functionalities.

The check valves may be produced by wet-etching (e.g. KOH etching), which results in the typical oblique etching edges as may be seen in FIG. 2. Alternatively, the check valves may also be produced by means of dry etching, whereby the oblique etching edges may be avoided, so that in total, less chip area may be used.

The check valve module 36 comprises two silicon wafers 36*a* and 36*b*, which have the features of the check valves structured therein and are connected to each other on two main surfaces of same. The passive check valve 32 comprises a valve flap 32*a* structured into the silicon wafer 36*b*, and a valve seat 32*b* structured into the silicon wafer 36*a*. The passive check valve 34 comprises a valve flap 34*a* structured into the silicon wafer 36*a*, and a valve seat 34*b* structured into the silicon wafer 36*b*. The valve seats 32*b* and 34*b* provide respective support faces or support ridges for the valve flaps 32*a* and 34*a*.

FIGS. 1 and 2 show schematic cross sectional views of an embodiment of the invention. In embodiments, the pump chamber 26 comprises, in a top view, a round shape, i.e. a round circumference, the pump diaphragm 14 also being configured to be round, accordingly. The inlet opening 28 and the outlet opening 30 are provided opposite each other within a central area of the pump diaphragm 14.

In operation, the driver means 24 applies an actuating voltage to the piezo actuator 16 during a delivery stroke, so that the pump diaphragm 14 is deflected in a direction toward the inlet opening 28 and the outlet opening 30. In this manner, excess pressure is generated within the pump chamber 26, which excess pressure opens the passive outlet valve 34, so that fluid flows out of the outlet opening 30 during the delivery stroke. During a subsequent suction stroke, the actuating voltage is switched off, so that the pump diaphragm returns to its initial position as is shown, for example, in FIG. 1. This leads to a negative pressure within the pump chamber 26 which causes fluid being sucked into the pump chamber 26 through the inlet valve 32. In embodiments of the invention, the return of the pump diaphragm to the initial position is due only to the pump diaphragm's elasticity.

The position of the pump diaphragm at the end of the delivery stroke, and the position of the pump diaphragm at the end of the suction stroke, may be regarded as two end positions since said positions are those positions of the pump diaphragm where the movement of the pump diaphragm ends for a given predefined design and a predefined actuation. The difference in volume between the two end positions corresponds to the stroke volume of the diaphragm pump. It shall be noted at this point that the actual end positions are dependent on the counterpressure existing in each case.

In the embodiment depicted, the diaphragm pump is configured such that by application of an actuating voltage, the pump diaphragm is deflected into that position in which the pump chamber volume is reduced. In alternative embodiments, the diaphragm pump may be configured such that by application of an actuating voltage, the pump diaphragm is deflected so as to increase the pump chamber volume. In such embodiments, the pump diaphragm may be biased into a position where the pump chamber volume is reduced.

In accordance with embodiments of the invention, the diameter and the thickness of the pump diaphragm 14, the natural frequency of the valve flaps 32*a* and 34*a*, the shape of the pump chamber 26, and the operating frequency of the actuating voltage applied by the driver means 24 are adapted such that with a diameter of the pump diaphragm of ≤50 mm, a delivery rate of at least 40 ml/min for liquids or at least 250 ml/min for gases is achieved. Corresponding parameters that may be adjusted to achieve this, or measures that may be taken to achieve this, will be explained in more detail below.

At operating frequencies f below a cutoff frequency $f_g$, the delivery rate of diaphragm pumps is related to the stroke volume ΔV as follows:

$$Q=\Delta V\cdot f.$$

Figure 3:
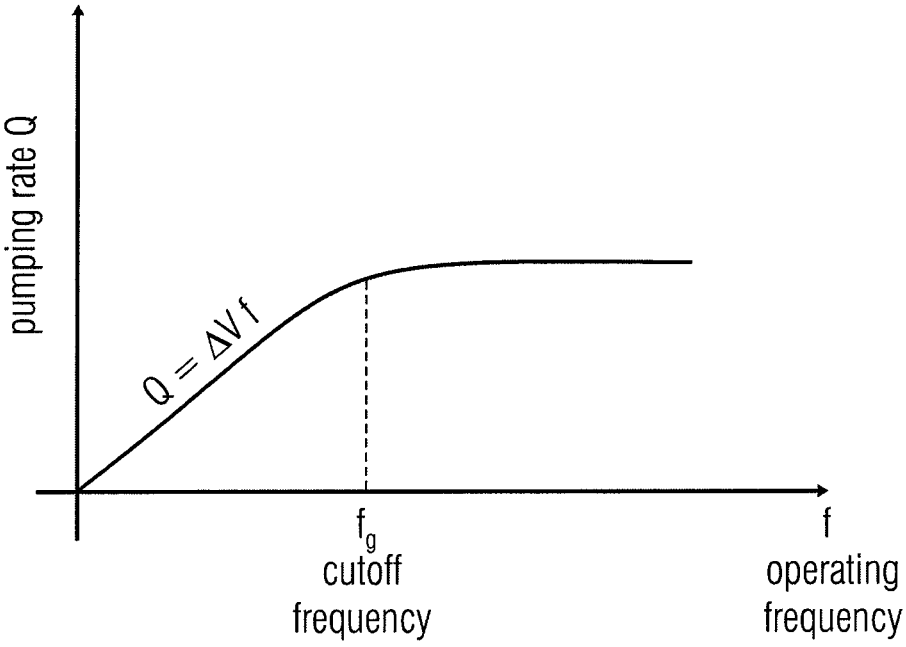
FIG. 3 shows a graph which depicts the pump rate versus the operating frequency.

As is shown in FIG. 3 of the present application, this linear range goes as far as a cutoff frequency $f_g$, which depends on the design of the pump. To increase the delivery rate, therefore, the stroke volume ΔV and the cutoff frequency $f_g$ may be increased. In embodiments, the stroke volume ΔV may be maximized in dependence on a maximum blocking pressure—predefined by utilization of the pump—of the bending converter, which is composed of the piezo actuator and the pump diaphragm. In addition, the cutoff frequency $f_g$ may be maximized, it being preferable to select the operating frequency to be smaller than the resonant frequency $f_{res}$ of the valves.

With regard to the design of the pump diaphragm, there are two main aspects, namely the stroke volume ΔV that can be generated, and the counterpressure that can be generated. Piezo diaphragm converters as may be formed, for example, by a pump diaphragm 14 and a piezo ceramic applied over a surface area, may generate a stroke volume with a defined counterpressure, or delivery stroke.

The following design rules result for a piezo bending converter having a round diaphragm and piezo ceramic deposited thereon. The following considerations are based on a piezo ceramic whose radius corresponds to 0.8 times the radius of the diaphragm. The following relationships apply to the stroke volume ΔV and the delivery stroke Δp of a round diaphragm:

$$\Delta V=0.4(E_3 d_{31} R^4)/h_p;$$

$$\Delta p=2.5(h_p/R)^2 E_3 d_{31} E_p.$$

$E_3$ designates the electric field perpendicular to the piezo diaphragm, i.e. in the thickness direction, $d_{31}$ designates a matrix element of the piezo matrix of the piezo ceramic, which indicates the degree of the relative change in length upon application of an electric field in the thickness direction, R designates the radius of the round diaphragm, $h_p$ designates the thickness of the piezo diagram, and $E_p$ designates the modulus of elasticity of the piezo ceramic.

For designing a piezo bending converter for a diaphragm pump, typically a stroke volume $V_0$ and a delivery stroke $p_0$ are defined on the basis of a reference design, and a stroke volume $V_1$ and a delivery stroke $p_1$ are defined on the basis of a specification of a desired diaphragm pump. What is sought for is the radius $R_1$ for the diaphragm of the desired diaphragm pump, as well as its thickness $h_{p1}$. When using the following ratios:

$$\alpha=V_1/V_0=(R_1/R_0)^4 h_{p0}/h_{p1}$$

$$\beta=p1/p0=(R_0/R_1)^2(h_{p1}/h_{p0})^2,$$

wherein $h_{p0}$ and $R_0$ designate the thickness and the radius, respectively, of the diaphragm of the reference pump, the following calculation specification results for the radius and thickness of the piezo diaphragm:

$$R_1=R_0 sqrt^6(\alpha^2\beta)$$

$$h_{p1}=h_{p0} sqrt^3(\alpha\beta^2).$$

Thus, the piezo diaphragm converter may be scaled with regard to large volumes and large pressures. The corresponding geometry parameters of the piezo diaphragm converter are the radius $R_1$ and the thickness $h_{p1}$ of the piezo diaphragm. To be able to implement the corresponding pump diaphragms at low cost, stainless spring steel diaphragms are used in embodiments of the present invention.

It is to be taken into account in this context that for relatively large piezo diaphragm thicknesses, relatively large applied voltages may be used. Maximally manageable voltages are limited in this context, for example to 1000 Volt, so that therefore, the possible thickness of the piezo diaphragm is also limited.

As has already been set forth, the cutoff frequency $f_g$ is that operating frequency of the micro pump at which the delivery characteristic leaves the linear range, as is depicted in FIG. 3. The cutoff frequency depends on the flow resistance of the passive check valves and on the flow resistance within the pump chamber, so that said factors are to be considered when searching for measures that may be taken to increase or maximize the cutoff frequency.

To illustrate this, the differential equation of a micro diaphragm pump in a homogenous pressure model shall be considered. This model shall be based on the assumption that there is a homogenous pump chamber pressure p. However, it should be said in advance that this model will lose its validity when the pump chamber is reduced to a small gap so as to reduce the dead volume and to maximize the compression ratio. However, this model illustrates an analytical connection between the cutoff frequency, the flow resistance at the valve, and the fluidic capacitances within the pump chamber.

The model will be described on the basis of the cross sectional representation shown in FIG. 4, which depicts a micro diaphragm pump comprising a pump diaphragm 14', a pump chamber 26', an inlet valve 32', and an outlet valve 34'. A gas bubble 40 within a liquid that is shown to be hatched is arranged within the pump chamber 26'.

The fundamental differential equation for the pump chamber pressure is as follows:

$$\frac{dp}{dt} = \frac{q_{IV} - q_{OV} - X_D\frac{dU_D}{dt}}{C_D + C_{OV} + C_{IV} + C_{gas} + C_{PC}}$$

$q_{IV}$ represents the influx through the inlet valve 32', $q_{OV}$ represents the outflow through the outlet valve 34', $X_D$ represents a piezo coupling term for the piezo bending converter, $U_D$ represents the drive voltage, $C_D$ represents the fluidic capacitance of the pump diaphragm, $C_{IV}$ represents the fluidic diaphragm of the inlet valve, $C_{OV}$ represents the fluidic capacitance of the outlet valve, $C_{gas}$ represents the fluidic capacitance of the gas-filled cavity 40, and $C_{PC}$ represents the fluidic capacitance of the pump chamber.

Figure 4:
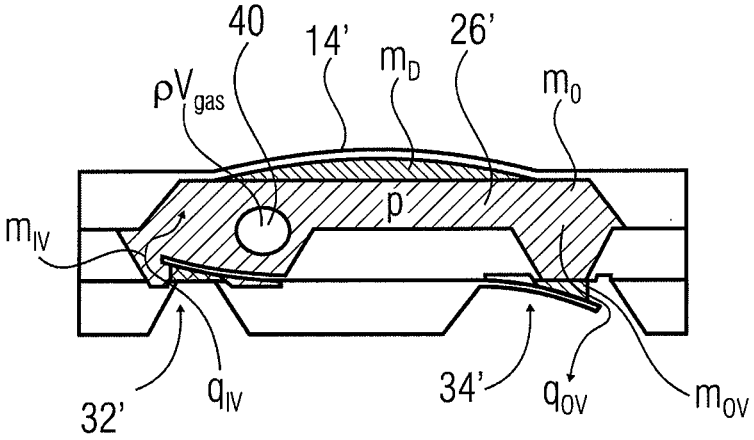
FIG. 4 shows a schematic cross sectional view of a model of a micro diaphragm pump.

The fluidic capacitances depend on the fluid masses $m_{IV}$, $m_D$, $m_0$ and $m_{OV}$ indicated in FIG. 4, wherein $m_{IV}$ designates the fluid mass to be moved by the check valve 32', $m_D$ designates the fluid mass to be moved by the diaphragm, $m_0$ designates the fluid mass within the dead volume of the pump chamber, and $m_{OV}$ designates the fluid mass to be moved by the check valve 34'.

What is also important is that the buildup of pressure during the suction and delivery strokes is fast, for example, upon application of a square-wave voltage to a piezo ceramic, at the time constant $\tau_A$=RC, which is fast as compared to $1/f_g$. R represents the electric charging resistance of the piezo ceramic, whereas C represents the electrical capacitance of the piezo ceramic. This condition may easily be met in the case of a piezo drive:

$$U_D(t) = U_{D0}\left(1 - e^{\frac{t}{\tau_A}}\right).$$

$U_{D0}$ is the amplitude of the square-wave voltage.

In a rough model, the flow resistance of the inlet and outlet valves may now be linearized:

$$q_{IV} = \frac{1}{R_{IV}}(p_1 - p);\ q_{OV} = \frac{1}{R_{OV}}(p - p_2)$$

$R_{IV}$ is the flow resistance of the inlet valve, $R_{OV}$ is the flow resistance at the outlet valve, $p_1$ is the pressure of the inlet, and $p_2$ is the pressure at the outlet.

Thus, the differential equation may be solved for the pump chamber pressure p, for example for the delivery stroke:

$$p(t) = \frac{X_D}{C_D + C_{OV} + C_{gas}} U_{D0} \frac{1}{1 - \frac{\tau_A}{\tau_P}}\left(e^{-\frac{t}{\tau_P}} - e^{-\frac{t}{\tau_A}}\right).$$

In the solution for the delivery stroke ($R_{IV}$ and $C_{IV}$ being neglected), the "typical traveling time" $\tau_p$ appears:

$$\tau_p = R_{OV}(C_D + C_{OV} + C_{gas})$$

The typical traveling time corresponds to the time taken up by the delivery stroke (or the suction stroke) to move the entire pump chamber volume.

In other words, the cutoff frequency $f_g$ then corresponds at least to the inverse sum of the typical traveling time of the delivery and suction strokes:

$$f_g \geq \frac{1}{2\tau_p}$$

To increase the cutoff frequency, therefore, the flow resistance of the valve needs to be reduced, and the fluid capacitances of the diaphragm, valves and gas bubbles need to be reduced.

In order to reduce the flow resistance of the check valves, in embodiments of the invention, the width of the support ridge on which the valve flap rests in the closed state, may be reduced. With silicon micromechanics it is possible to reduce the width of the support ridge to a value of a few micrometers, for example 4 μm. The width of the support ridge is understood to mean the dimension of the support ridge along which a flowing fluid is moving when the check valve is in the open state, so that this width influences the fluid resistance of the check valve in the open state. For production-related reasons, support ridges of plastic valves that are produced by injection molding, or support ridges of metal that are machined, cannot be made to be narrower than 50-100 μm without any major expenditure, which result in a considerably higher flow resistance.

Therefore, in embodiments of the present invention, the check valves are configured as silicon valves, since this enables implementation of lower flow resistances at low expenditure.

In addition, in order to increase the cutoff frequency $f_g$, the fluidic capacitances may also be reduced. As a rule, the fluidic capacitances of the valve flaps $C_{OV}$ and $C_{IV}$ are small as compared to the capacitance of the pump diaphragm $C_D$, and the latter is small as compared to the fluidic capacitance of gas-filled cavities $C_{gas}$. In the worst gas, a gas bubble assumes the entire volume of the pump chamber $V_{dead}$, which results in the following fluidic capacitance:

$$C_{gas} = \frac{\rho_{fl} V_{dead}}{P_{AT}}$$

$\rho_{fl}$ designates the density of the gas, $V_{dead}$ designates the dead volume of the pump chamber, and $p_{AT}$ designates the atmospheric pressure (one may typically assume an atmospheric pressure of between 1000 and 1030 hPa). The requirement of reducing the fluidic capacitance of potential gas bubbles is therefore equivalent with the requirement of reducing the dead volume of the pump chamber. However, it is to be noted in this context that if the pump chamber is too narrow, the flow resistance within the pump chamber will be predominant.

Figure 5:
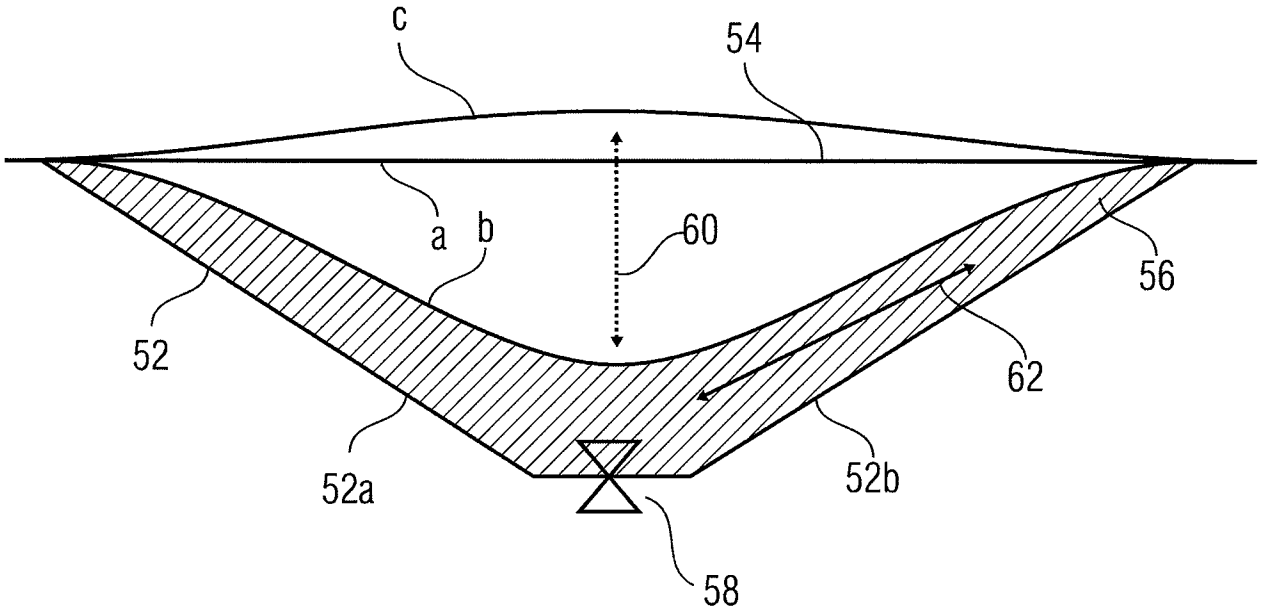
FIG. 5 shows a schematic representation to illustrate a pump chamber in accordance with an embodiment of the invention.
Figure 6:
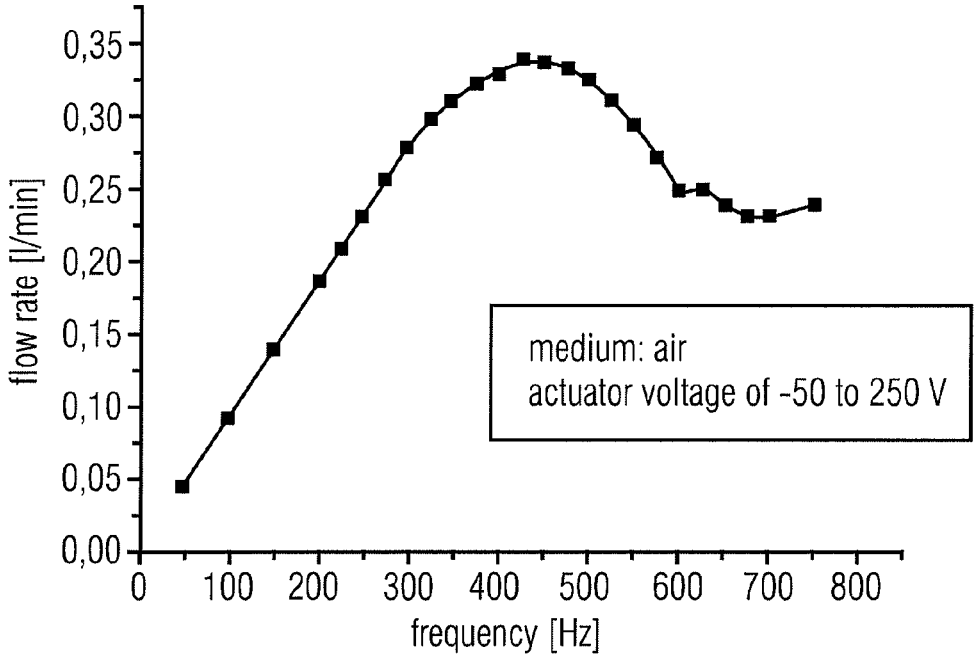
FIGS. 6 to 9 show graphs which depict flow rates as a function of the operating frequency and the counterpressure for air and water as the medium to be pumped.
Figure 7:
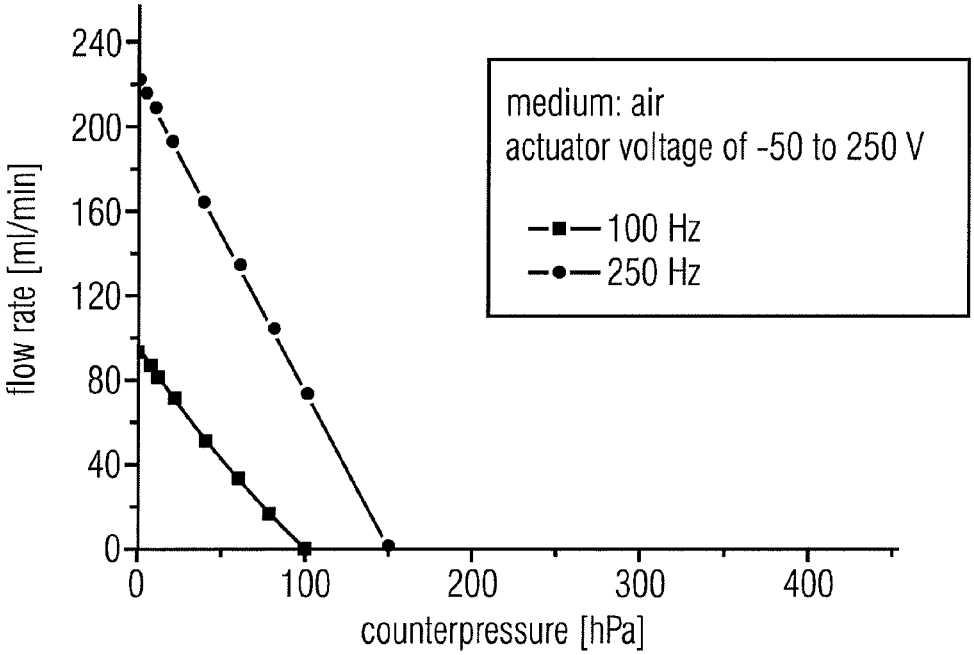
Figure 8:
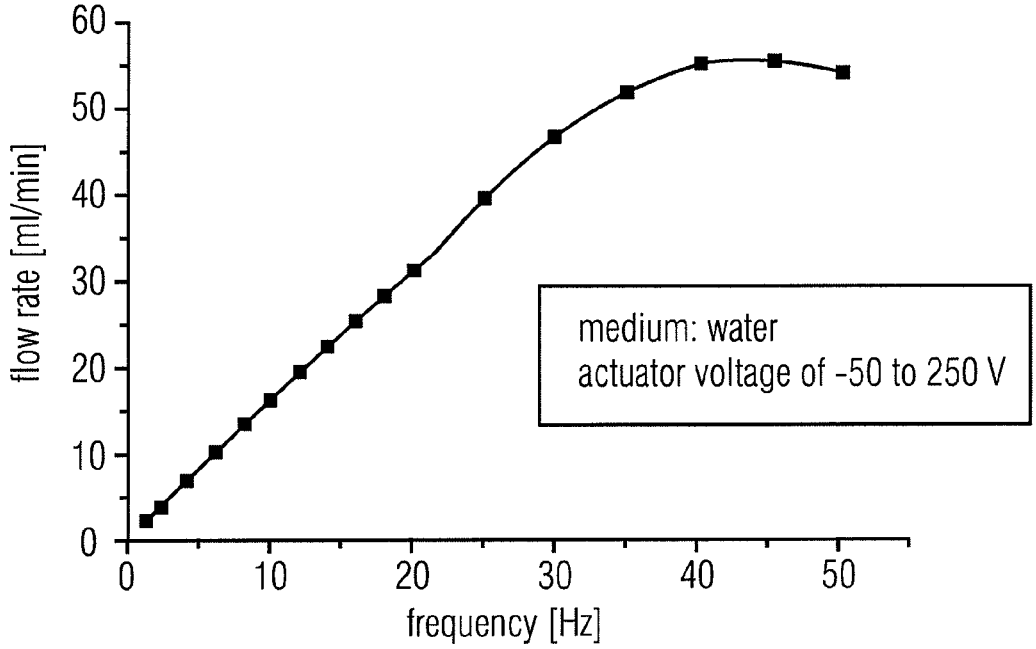
Figure 9:
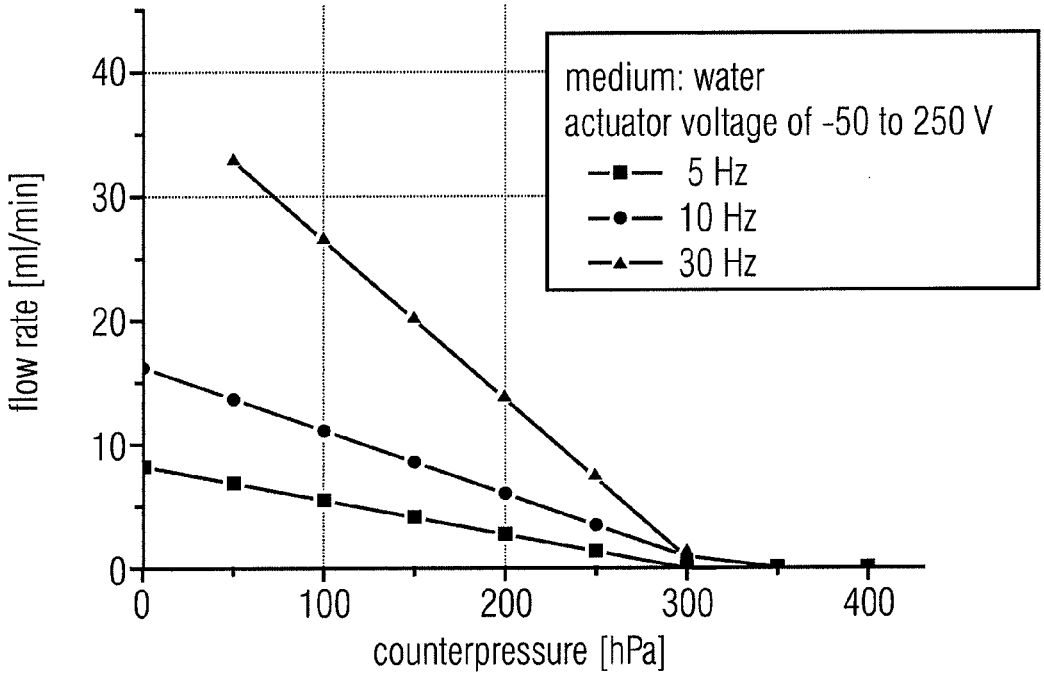

FIG. 5 schematically shows a pump chamber 56 defined by a pump body 52 and a pump diaphragm 54. Check valves at an inlet opening and an outlet opening are schematically shown at 58 in FIG. 5. In addition, in FIG. 5, a movement of the pump diaphragm 54 is indicated by a bidirectional arrow 60, three positions of the pump diaphragm 54 being shown in FIG. 5. A position a shows an initial position of the pump diaphragm, the position b shows the pump diaphragm in the actuated state, and the position c shows the pump diaphragm overshooting the initial position a after a suction stroke. A bidirectional arrow 62 shows a flow within the pump chamber 56, the flow being directed toward the valves 58 during a delivery stroke, whereas the flow is directed away from said valves during a suction stroke.

To reduce the dead volume and, thus, the fluidic capacitance of a gas bubble, in embodiments of the invention, the pump chamber floor, i.e. the recess which is formed in the pump body 52 and defines the pump chamber, is adapted to the maximum deflection of the diaphragm 54. This is indicated, in FIG. 5, by the obliquely running areas 52*a* and 52*b* of the pump chamber floor. However, if the pump chamber floor and the pump diaphragm are configured such that the fixed gap between the diaphragm and the pump chamber floor disappears, the flow resistance and, thus, the cutoff frequency will increase toward infinity. Therefore, there is an optimum residual gap distance at which the delivery rate is maximized even in a worst-case consideration.

In embodiments of the present invention, the diaphragm pump is therefore configured such that in the event of a complete deflection of the diaphragm toward the pump chamber floor, which deflection is caused by the actuation, a residual gap will remain which is dimensioned such that the flow resistance of the flow passing through said residual gap is no larger than the flow resistance of the passive check valve at the inlet opening or outlet opening.

In order to allow that the micro valves may follow any pressure changes within the pump chamber without any delay, the self-resonant frequency $F_{res}$ of the valves should be above the cutoff frequency $f_g$.

The resonant frequency $f_{res}$ of a valve flap, freely oscillating in the air, of a passive check valve is as follows:

$$2\pi f_{res} = \omega_{res} = \frac{t_f}{2l_f^2}\sqrt{\frac{E}{\rho_f}}$$

$t_f$ represents the thickness of the valve flap, $l_f$ represents the length of the valve flap, $\rho_f$ represents the density of the valve flap, and E represents the modulus of elasticity of the valve flap.

The natural frequency is independent of the flap width. With a silicon flap valve (with $t_f$=15 μm, $l_f$=1.7 mm, $\rho_f$=2100 kg/m$^3$, E=169 GPa), a natural frequency of $f_{res}=\omega_{res}/(2\pi)$=3.6 kHz results.

In a liquid environment, the natural frequency of the valve flap decreases, since it also may accelerate liquid during the movement, and since, therefore, a considerably larger moment of inertia is to be assumed. This problem can no longer be solved analytically, since in this case, it may be useful to couple elasto mechanics with fluid mechanics while taking into account the terms of inertia of the valve flap and the liquid. A simulation has shown a natural frequency $f_{res}$ of a valve flap, having the above-indicated dimensions, in a liquid environment to be $f_{res}$=830 Hz. Therefore, said natural frequency is lower, by a factor of 4, than the natural frequency in air.

A plastic flap valve having the same geometry dimensions and having a modulus of elasticity of 5 GPa, has a resonant frequency that is lower by the factor sqrt (5/169)=0.17, i.e., in the numerical example indicated, a resonant frequency of only 142 Hz.

Exemplary dimensions for an embodiment of an inventive diaphragm pump will be indicated below. The diameter of the micro pump, i.e. the diameter of the pump chamber or of the pump diaphragm, may be 30 mm, the thickness of the diaphragm may be 150 μm, the thickness of the piezo actuator may be 300 μm, and the diameter of the piezo actuator may be 23.8 mm. A blocking pressure of 630 hPa may be generated upon application of a voltage between Umin of −90 V and Umax of 450 V. Exemplary actuator data are as follows:

blocking pressure: 630 hPa
stroke volume: 32.1 μl
dead volume: 16.7 μl
usable stroke volume (with an adiabatic compression): 30.5 μl.

For different cutoff frequencies $f_g$, the following maximum flow Q may be achieved:

| cutoff frequency $f_g$ | maximum flow Q |
|---|---|
| 67 Hz | 120 ml/min |
| 546 Hz | 1 liter/min |

Utilization of passive silicon check valves for diaphragm pumps, and in particular diaphragm pumps of small sizes and high deliveries, is advantageous since said passive silicon check valves have a high resonant frequency as compared to plastic valves. In addition, silicon can be structured with high precision, with very narrow (having a width of several micrometers) support ridges, which results in a flow resistance that is low as compared to plastic valves (which have a broad support ridge of a width of about 100 μm), which in turn increases the cutoff frequency. In addition, silicon valves have low space requirements, it being possible, for example, for the check valve module 36 to have a chip size of 3×4 $mm^2$. In addition, silicon valves are free from fatigue and exhibit ideal-elastic behavior.

The present invention thus enables implementation of low-cost diaphragm pumps, in particular micro diaphragm pumps having high delivery rates while taking up minimum installation space.

In particular, embodiments of the invention enable a high delivery rate of 40 ml/min for a liquid to be delivered, or of 250 ml/min for a gas to be delivered, with a pump diaphragm diameter ≤50 mm. In the event of a non-circular shape, corresponding delivery rates may be achieved with a largest extension of the pump diaphragm in one direction being ≤50 mm.

Inventive diaphragm pumps may be advantageously employed in a multitude of areas. Examples of use are, e.g., pneumatic pumps for fuel cells, wherein delivery rates of typically 1-5 liters/min and counterpressures of typically 50 hPa-500 hPa may be used. In addition, embodiments of the inventive diaphragm pumps may be employed as liquid pumps for fuel cells, for example methanol/water metering pumps, with delivery rates of 80 ml/min that may be useful. Embodiments of inventive pumps may also be used as water pumps for moistening breathing air, as liquid pumps for infusion applications with delivery rates of up to 200 ml/min, or as micro pumps for cooling systems, e.g. water with a delivery rate of 50 ml/min at a counterpressure of 200 hPa.

FIGS. 6 to 9 schematically show results that have been achieved by the implementation of an embodiment of an inventive pump having an overall diameter of 30 mm and an overall thickness of 4 mm (without plug).

In the above-described embodiments, a check valve is provided at the inlet, and a check valve is provided at the outlet. Alternatively, it is also possible to provide, at the inlet and/or outlet, two check valves in parallel or in series. For example, two valve seats and one associated valve flap, respectively, might be provided side by side at the inlet and/or outlet.

The passive check valves may be integrated in a silicon chip or chip module attached (e.g. glued) within a corresponding recess within the pump body. Alternatively, the check valves may be provided in separate chips attached (e.g. glued) within separate recesses of the pump body, so that a ridge of the pump body extends between the recesses. In this manner, potential cross-leaking problems may be avoided, which may occur when the distance between two check valves formed within a chip becomes small.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A diaphragm pump, comprising:

a pump chamber comprising an inlet opening and an outlet opening;

a passive silicon check valve at the inlet opening;

a passive silicon check valve at the outlet opening;

a metallic pump diaphragm that adjoins the pump chamber; and an actuator for moving the pump diaphragm from a first end position, which defines a first pump chamber volume, to a second end position, which defines a second pump chamber volume, a difference between the first pump chamber volume and the second pump chamber volume defining a stroke volume, wherein the pump chamber comprises a pump chamber floor, which is opposite the metallic pump diaphragm, said pump chamber floor being adapted to the maximum deflection of the pump diaphragm, a gap remaining between the pump chamber floor and the pump diaphragm when the pump diaphragm is in the second end position, which defines a smaller pump chamber volume than the first end position, which gap offers, for a flow through the gap, a flow resistance no larger than a flow resistance of the passive check valve at the outlet opening or than a flow resistance of the passive check vale at the inlet opening, wherein the check valves comprise a valve flap and a support ridge on which the valve flap rests when the check valve is closed, said support ridge comprising a width of ≤50 μm, ≤10 μm, or ≤5 μm, and wherein the gap that remains between the pump chamber floor and the pump diaphragm when the pump diaphragm is in the second end position that defines a smaller pump chamber volume than the first end position is larger in a central area of the pump chamber than in an edge area of the pump chamber.

2. The diaphragm pump as claimed in claim 1, wherein the actuator comprises a piezo ceramic arranged on the pump diaphragm.

3. The diaphragm pump as claimed in claim 1, wherein the actuator is configured to actuate the pump diaphragm at an operating frequency that is smaller than a self-resonant frequency of valve flaps of the passive check valves, a largest extension of the pump diaphragm in one direction is ≤50 mm; and the extension and a thickness of the pump diaphragm, a flow resistance of the passive check valves, and a shape of the pump chamber with regard to a dead volume and a flow resistance being configured such that a delivery rate of the diaphragm pump, when the pump diaphragm is actuated at the operating frequency, is ≥40 ml/min for a liquid to be delivered, or ≥250 ml/min for a gas to be delivered.

4. The diaphragm pump as claimed in claim 1, wherein the pump chamber floor is shaped such that the gap that remains between the pump chamber floor and the pump diaphragm when the pump diaphragm is in the second end position that defines a smaller pump chamber volume than the first end position is larger, in an area opposite the outlet opening and the inlet opening, than in an area of the pump diaphragm that is spaced apart from said former area.

5. The diaphragm pump as claimed in claim 1, wherein the pump chamber is circular, as viewed from the top, and wherein the inlet opening and the outlet opening are arranged opposite a central area of the pump diaphragm.

6. The diaphragm pump as claimed in claim 1, wherein the metallic pump diaphragm comprises a stainless-steel diaphragm.

7. The diaphragm pump as claimed in claim 1, wherein the pump chamber is formed within a pump body.

8. The diaphragm pump as claimed in claim 7, wherein the pump body is comprised of plastic.

9. A diaphragm pump, comprising:

a pump chamber comprising an inlet opening and an outlet opening that are provided with passive check valves;

a pump diaphragm that adjoins the pump chamber; and an actuator for actuating the pump diaphragm at an operating frequency that is smaller than a self-resonant frequency of valve flaps of the passive check valves, a largest extension of the pump diaphragm in one direction being ≤50 mm; and the extension and a thickness of the pump diaphragm, a flow resistance of the passive check valves, and a shape of the pump chamber with regard to a dead volume and a flow resistance being configured such that a delivery rate of the diaphragm pump, when the pump diaphragm is actuated at the operating frequency, being ≥40 ml/min for a liquid to be delivered, or ≥250 ml/min for a gas to be delivered, wherein the pump chamber comprises a pump chamber floor, which is opposite the pump diaphragm, said pump chamber floor being adapted to the maximum deflection of the pump diaphragm, and a gap remaining between the pump chamber floor and the pump diaphragm when the pump diaphragm is in a second end position, which defines a smaller pump chamber volume than a first end position, which gap offers, for a flow through the gap, a flow resistance no larger than a flow resistance of the passive check valve at the outlet opening or than a flow resistance of the passive check vale at the inlet opening, wherein the check valves comprise a valve flap and a support ridge on which the valve flap rests when the check valve is closed, said support ridge comprising a width of ≤50 μm, ≤10 μm, or ≤5 μm, and wherein the gap that remains between the pump chamber floor and the pump diaphragm when the pump diaphragm is in the second end position that defines a smaller pump chamber volume than the first end position is larger in a central area of the pump chamber than in an edge area of the pump chamber.

10. The diaphragm pump as claimed in claim 9, wherein the pump chamber floor is shaped such that the gap that remains between the pump chamber floor and the pump diaphragm when the pump diaphragm is in the second end position that defines a smaller pump chamber volume than the first end position is larger, in an area opposite the outlet opening and the inlet opening, than in an area of the pump diaphragm that is spaced apart from said former area.

11. The diaphragm pump as claimed in claim 9, wherein the pump chamber is circular, as viewed from the top, and wherein the inlet opening and the outlet opening are arranged opposite a central area of the pump diaphragm.

12. The diaphragm pump as claimed in claim 1, wherein the passive check valves are formed within a shared component.

13. The diaphragm pump as claimed in claim 1, wherein the passive check valves are formed within separate components.

* * * * *

UNITED STATES PATENT AND TRADEMARK OFFICE

CERTIFICATE OF CORRECTION

PATENT NO. : 8,746,130 B2
APPLICATION NO. : 12/739366
DATED : June 10, 2014
INVENTOR(S) : Martin Wackerle and Martin Richter It is certified that error appears in the above-identified patent and that said Letters Patent is hereby corrected as shown below:

On the title page

Item 75 Inventors:

Martin Wackerle, München (DE);

should read:

Martin Wackerle, Munich (DE);

Item 73 Assignee:

Fraunhofer-Gesellschaft zur Foerderung der Angewandten Forschung E.V.

should be:

Fraunhofer-Gesellschaft zur Foerderung der angewandten Forschung e.V.

Signed and Sealed this
Ninth Day of February, 2016

Michelle K. Lee

Michelle K. Lee
*Director of the United States Patent and Trademark Office*